US009825395B2

(12) United States Patent
Gooch et al.

(10) Patent No.: US 9,825,395 B2
(45) Date of Patent: Nov. 21, 2017

(54) PROTECTIVE COVER FOR A CONNECTOR

(71) Applicant: Tyco Electronics Corporation, Berwyn, PA (US)

(72) Inventors: William Dreghorn Gooch, Hamburg, PA (US); Tracy Lee Smith, Harrisburg, PA (US); Kevin Edward Weidner, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/712,294

(22) Filed: May 14, 2015

(65) Prior Publication Data

US 2016/0336680 A1 Nov. 17, 2016

(51) Int. Cl.
*H01R 13/447* (2006.01)

(52) U.S. Cl.
CPC ..... *H01R 13/447* (2013.01)

(58) Field of Classification Search
CPC .. H01R 13/501; H01R 13/5213; H01R 13/46; H01R 13/506; H01R 13/514; H01R 13/52; H01R 13/516; H01R 13/512; H01R 13/5219; H01R 13/502; H01R 13/5045
USPC ..... 439/589, 569, 571–573, 904, 915
See application file for complete search history.

(56) References Cited

U.S. PATENT DOCUMENTS 3,109,124 A * 10/1963 Sinninger ..... H01R 33/945 174/371
3,224,796 A * 12/1965 Burkitt ..... F16L 5/022 174/153 R
3,708,185 A * 1/1973 Bilicki ..... E04D 13/1407 285/419
3,904,265 A * 9/1975 Hollyday ..... H01R 13/516 439/469
4,482,200 A * 11/1984 Willenborg ..... H01R 13/516 439/460
4,634,196 A * 1/1987 Nestell ..... B60J 3/0221 296/97.13
5,406,032 A * 4/1995 Clayton ..... H02G 3/083 174/151
5,419,721 A * 5/1995 Lignelet ..... H01R 13/514 439/364
6,036,543 A * 3/2000 Panis ..... H01R 13/516 439/607.01

(Continued)

*Primary Examiner* — James Harvey
*Assistant Examiner* — Oscar C Jimenez

(57) ABSTRACT

A protective cover is provided for a connector that is mounted to a host structure. The cover includes a metal shell having a body defined by at least one shell segment that includes a base and a support wall that extends outward from the base. The support wall includes an interior side that defines a connector pocket configured to receive a corresponding sub-segment of a cantilevered connector segment of the connector. The base of the shell segment is configured to be mounted to the host structure with the support wall extending outward from the host structure over the corresponding sub-segment of the cantilevered connector segment such that the body of the metal shell is cantilevered from the host structure around at least a portion of a circumference and along at least a portion of a length of the cantilevered connector segment to provide a metal barrier that covers at least a portion of the cantilevered connector segment.

20 Claims, 4 Drawing Sheets

(56) References Cited

U.S. PATENT DOCUMENTS

| | | | | |
|---|---|---|---|---|
| 6,180,882 | B1 * | 1/2001 | Dinh | H02G 3/22 16/2.2 |
| 6,921,281 | B2 * | 7/2005 | Chen | H01R 13/5825 439/447 |
| 2004/0177989 | A1 * | 9/2004 | Nass | H01R 13/5205 174/655 |
| 2014/0069904 | A1 * | 3/2014 | Sammons | H01R 13/502 219/136 |
| 2017/0125944 | A1 * | 5/2017 | Yokoyama | H01R 13/502 |

* cited by examiner

PROTECTIVE COVER FOR A CONNECTOR

BACKGROUND OF THE INVENTION

The subject matter described and/or illustrated herein relates generally to connectors.

Connectors (e.g., electrical connectors, optical connectors, etc.) are used to interconnect a wide variety of electronic devices, optical devices, networks, systems, and/or the like. Connectors may be susceptible to impact damage. For example, some known connectors extend outwardly from a host structure in a cantilevered arrangement. Such cantilevered connectors may be particularly susceptible to impact damage, for example by being inadvertently hit, bumped, kicked, and/or the like by a person and/or by being impacted by another object, such as a tool, a door, a vehicle, a falling object, and/or the like. When impacted by a person or an object, such cantilevered connectors may be damaged. For example, a cantilevered connector may be completely or partially severed from the host structure by an impact. Impact damage experienced by connectors may be costly because of the cost of repairing or replacing the damaged connector. Moreover, connectors that are partially or completely severed by an impact may expose electrical contacts that present a hazardous electrical issue.

BRIEF DESCRIPTION OF THE INVENTION

In an embodiment, a protective cover is provided for a connector that is mounted to a host structure. The cover includes a metal shell having a body defined by at least one shell segment that includes a base and a support wall that extends outward from the base. The support wall includes an interior side that defines a connector pocket. The connector pocket is configured to receive therein a corresponding sub-segment of a cantilevered connector segment of the connector that is cantilevered from the host structure. The base of the shell segment is configured to be mounted to the host structure with the support wall extending outward from the host structure over the corresponding sub-segment of the cantilevered connector segment such that the body of the metal shell is cantilevered from the host structure around at least a portion of a circumference and along at least a portion of a length of the cantilevered connector segment to provide a metal barrier that covers at least a portion of the cantilevered connector segment of the connector.

In an embodiment, a connector assembly includes a connector that includes a cantilevered connector segment. The connector is configured to be mounted to a host structure such that the cantilevered connector segment is cantilevered from the host structure. The cantilevered connector segment includes at least one sub-segment. A protective cover for the connector includes a metal shell having a body defined by at least one shell segment that includes a base and a support wall that extends outward from the base. The support wall includes an interior side that defines a connector pocket. The connector pocket is configured to receive the sub-segment of the cantilevered connector segment of the connector therein. The base of the shell segment is configured to be mounted to the host structure with the support wall extending outward from the host structure over the sub-segment of the cantilevered connector segment such that the body of the metal shell is cantilevered from the host structure around at least a portion of a circumference and along at least a portion of a length of the cantilevered connector segment to provide a metal barrier that covers at least a portion of the cantilevered connector segment of the connector.

In an embodiment, a protective cover is provided for a connector that is mounted to a host structure. The cover includes a metal shell having a body defined by at least one shell segment that includes a base and a support wall that extends outward from the base. The support wall includes an interior side that defines a connector pocket. The connector pocket is configured to receive therein a corresponding sub-segment of a cantilevered connector segment of the connector that is cantilevered from the host structure. The base of the shell segment is configured to be mounted to the host structure over a mounting flange of the connector such that the support wall extends outward from the base over the corresponding sub-segment of the cantilevered connector segment to provide a metal barrier that covers at least a portion of the cantilevered connector segment of the connector.

DETAILED DESCRIPTION OF THE INVENTION

Figure 1:
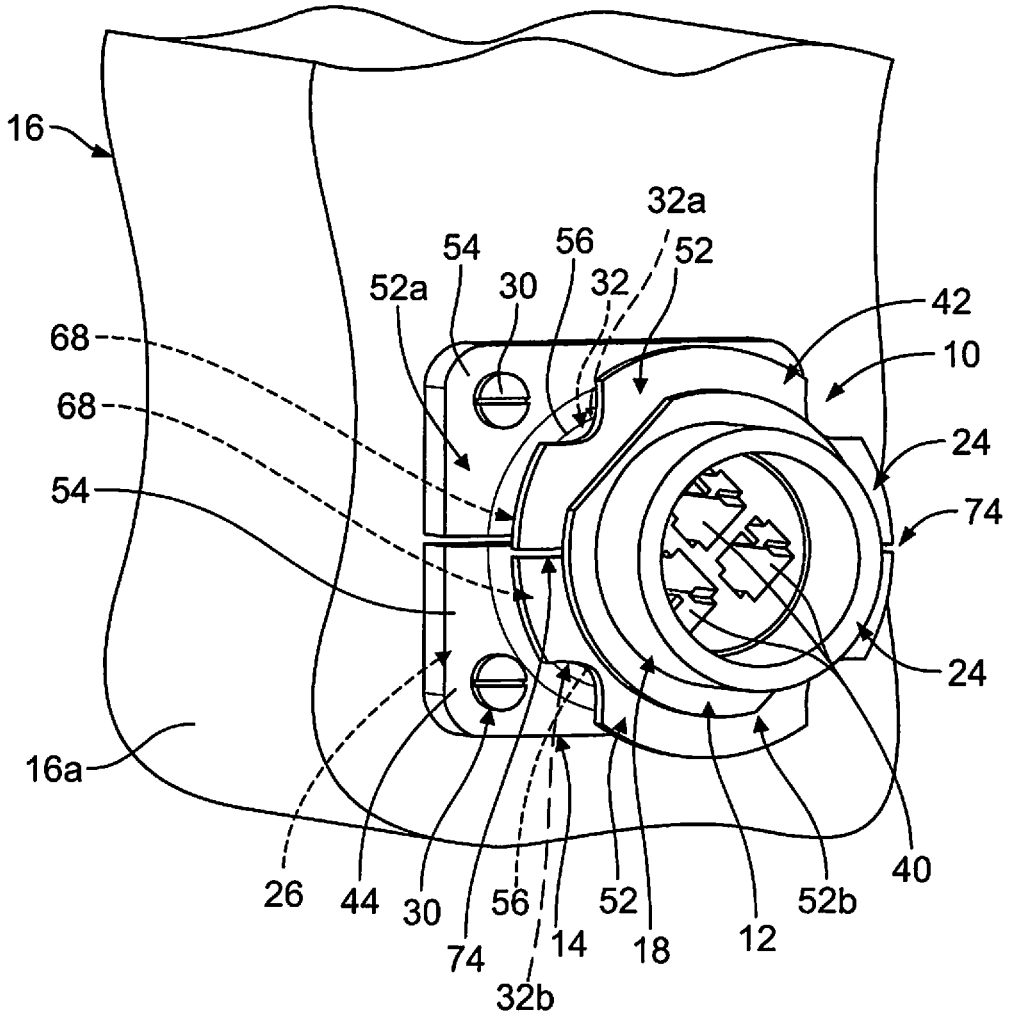
FIG. 1 is a perspective view of an embodiment of a connector assembly illustrating the assembly mounted to a host structure.

FIG. 1 is a perspective view of an embodiment of a connector assembly 10 and a host structure 16. The assembly 10 includes a connector 12 and a protective cover 14 for the connector 12. The connector 12 and the cover 14 are mounted to the host structure 16. Specifically, the connector 12 is mounted to the host structure 16 such that the connector 12 is cantilevered from the host structure 16. As will be described in more detail below, the cover 14 is mounted to the host structure 16 such that the cover 14 provides a metal barrier that covers at least a portion of the connector 12 for protecting the connector 12 from impact damage.

The illustrated embodiment of the host structure 16 is meant as only one example of a host structure. The host structure 16 may be any structure having any shape, geometry, application, and/or the like. In the illustrated embodiment, the host structure 16 includes an approximately vertical wall 16*a* (only a portion of which is shown herein) from which the connector 12 extends outwardly in the cantilevered arrangement shown herein and described in more detail below. But, the host structure 16 may include any other structure, such as, but not limited to, an approximately horizontal wall (or a wall having another angle besides approximately vertical or approximately horizontal) from which the connector 12 extends outwardly in a cantilevered arrangement. The host structure 16 may be a stationary structure that is fixed in place, or may be a movable structure that is moved between different locations, oriented in different orientations, and/or the like. It should be understood that the angle of the wall 16*a* may change between approximately vertical, approximately horizontal, and/or other angles in embodiments wherein the host structure 16 is moveable between different locations, different orientations, and/or the like. The application of the illustrated embodiment of the host structure 16 is a miniature cell tower used for providing cellular telephone service. But, as discussed above, the host structure 16 additionally or alternatively may have any other application(s).

Figure 2:
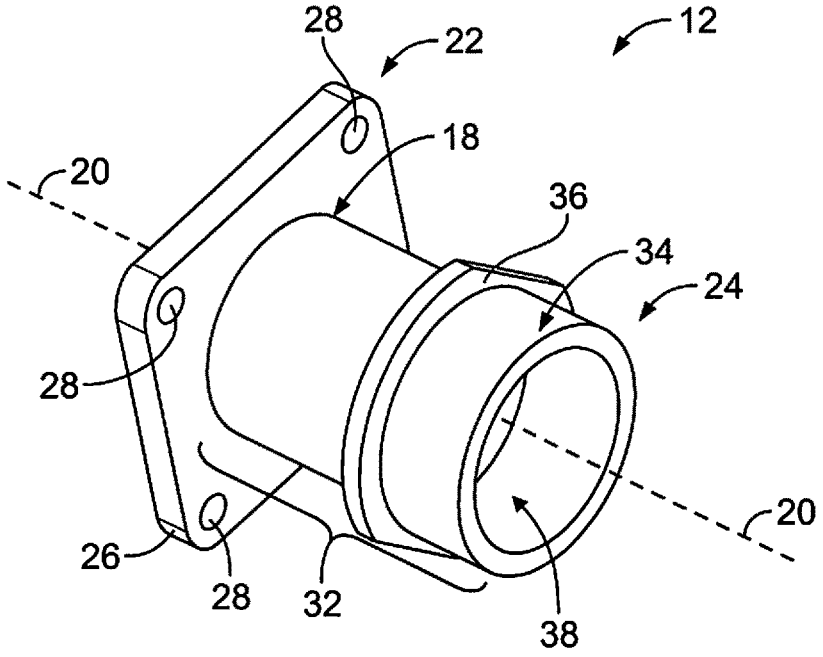
FIG. 2 is a perspective view of an embodiment of a connector of the connector assembly shown in FIG. 1.
Figure 5:
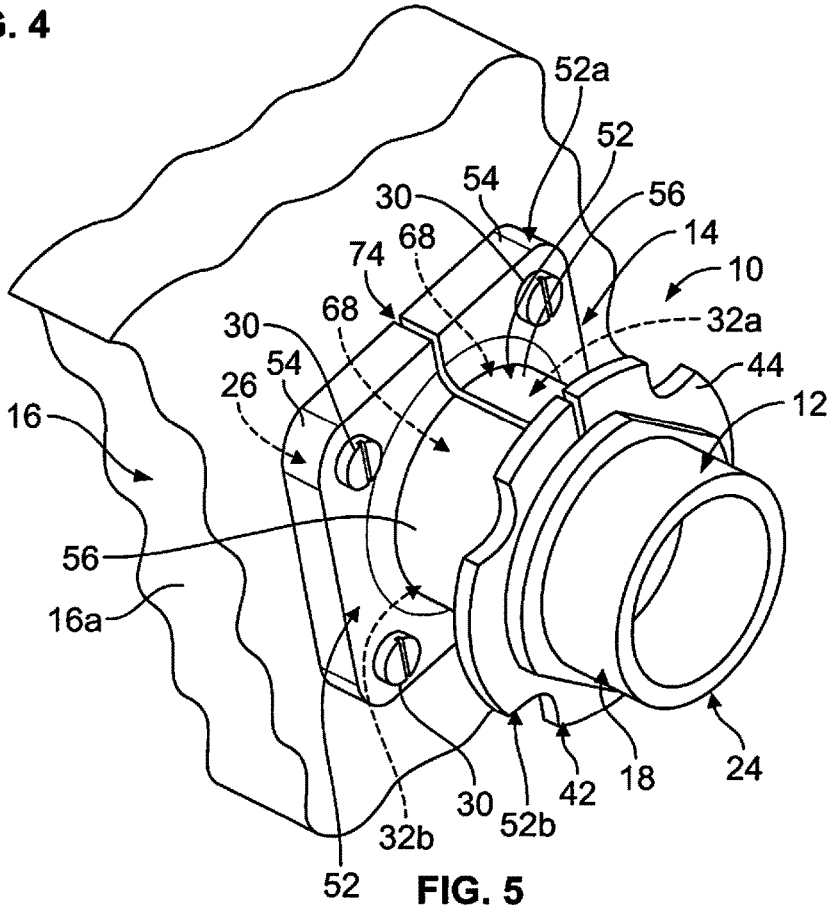
FIG. 5 is another perspective view of the connector assembly shown in FIGS. 1 and 3 illustrating the assembly mounted to the host structure.
Figure 7:
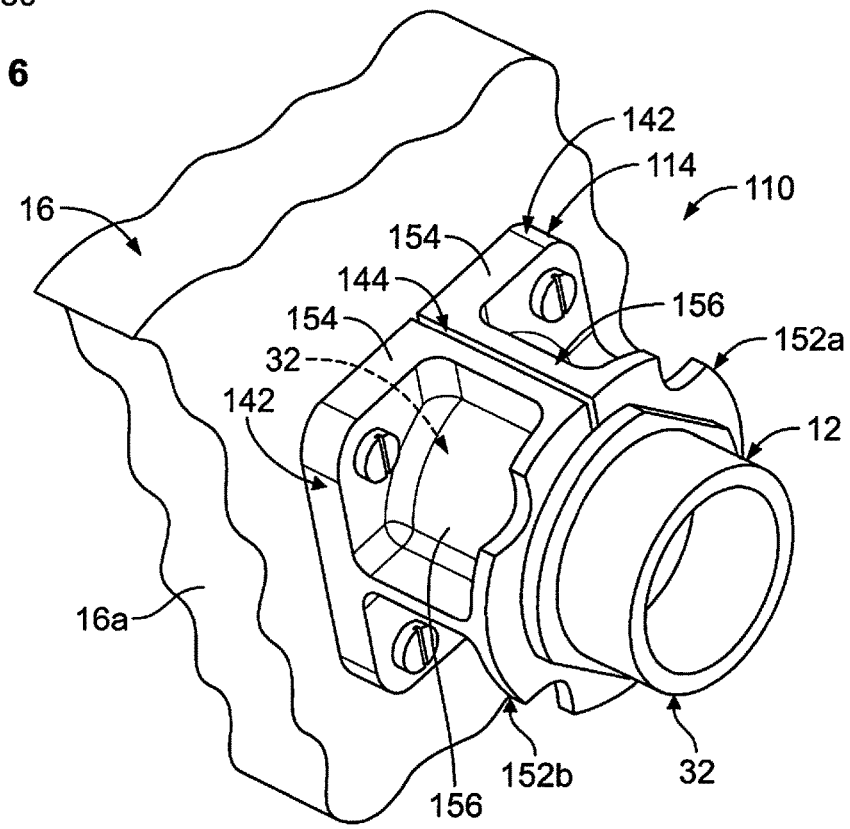
FIG. 7 is a perspective view of an embodiment of another connector assembly that includes the protective cover partially shown in FIG. 6 illustrating the assembly mounted to the host structure.

FIG. 2 is a perspective view of an embodiment of the connector 12. The connector 12 includes a body 18 that extends a length along a central longitudinal axis 20 from a mounting end 22 to a mating end 24. The mounting end 22 includes a mounting flange 26 for mounting the connector 12 to the wall 16*a* (FIGS. 1, 5, and 7) of the host structure 16 (FIGS. 1, 5, and 7). Specifically, in the illustrated embodiment, the mounting flange 26 includes mounting openings 28 that are configured to receive threaded fasteners 30 (FIGS. 1, 5, and 7) that cooperate with the host structure 16 (e.g., using threaded openings [not shown] of the host structure 16, using openings [not shown] of the host structure 16 and threaded and/or non-threaded fasteners [not shown; e.g., threaded nuts] that connect with the threaded fasteners 30, and/or the like) for mounting the connector 12 to the wall 16*a*. But, the connector 12 is not limited to including the mounting flange 26 nor the mounting openings 28 for mounting the connector 12 to the host structure 16. Rather, in addition or alternatively to the mounting flange 26 and/or the mounting openings 28, the connector body 18 may include any other structure (e.g., one or more pins, one or more threaded mounting openings, a press-fit [i.e., an interference-fit] structure, a bayonet connection structure, one or more tabs and/or other structures for receiving a discrete clip, latch, clamp, and/or other non-threaded fastener, one or more integral clips, latches, clamps, and/or other non-threaded fasteners, and/or the like for mounting the connector 12 to the host structure 16. Although the illustrated embodiment includes four, the connector body 18 may include any number of the mounting openings 28.

The connector body 18 includes a segment 32 (referred to herein as a "cantilevered connector segment") that is configured to be cantilevered from the host structure 12, as will be described below. The cantilevered connector segment 32 of the body 18 extends a length outward from the mounting flange 26 along the central longitudinal axis 20 to the mating end 24 of the body 18. The cantilevered connector segment 32 includes the mating end 24 of the body 18.

The connector 12 is configured to mate with a complementary mating connector (not shown) at the mating end 24 of the connector 12. In the illustrated embodiment, the mating end 24 includes a bayonet connection structure 34 (including an optional flange 36) for mating with the mating connector with a bayonet type connection. Moreover, the illustrated embodiment of the mating end 24 of the connector 12 includes a receptacle 38 for receiving a plug (not shown) of the mating connector therein. But, in addition or alternatively to the bayonet connection structure 34 and/or the receptacle 38, the mating end 24 of the connector 12 may include any other structure for mating with the mating connector, such as, but not limited to, a plug, a threaded segment, a quarter-turn structure, a half-turn structure, an interference fit structure, a snap fit structure, and/or the like.

The connector 12 may be any type of connector, such as, but not limited to, an electrical connector for conveying electrical energy, an optical connector for conveying light, a power connector for supplying electrical power, a signal connector for conveying electrical and/or optical signals, and/or the like. In the illustrated embodiment, the connector 12 is a power connector that is configured to provide electrical power from a power source to the miniature cell tower of the host structure 16. In some other embodiments, the connector 12 may be used to supply electrical power from the host structure 12 to another device (not shown).

As shown in FIG. 1, the illustrated embodiment of the mating end 24 of the connector body 18 includes three optional contact cavities 40 that hold contacts (not shown) that mate with corresponding mating contacts of the mating connector to establish an electrical and/or optical connection with the mating connector. But, the mating end 24 of the connector body 18 additionally or alternatively may include any other structure for connecting to the complementary connector. Moreover, the connector body 18 may include any number of the contact cavities 40 and may hold any number of the contacts, each of which may have any structure for mating with the corresponding mating contact.

Figure 3:
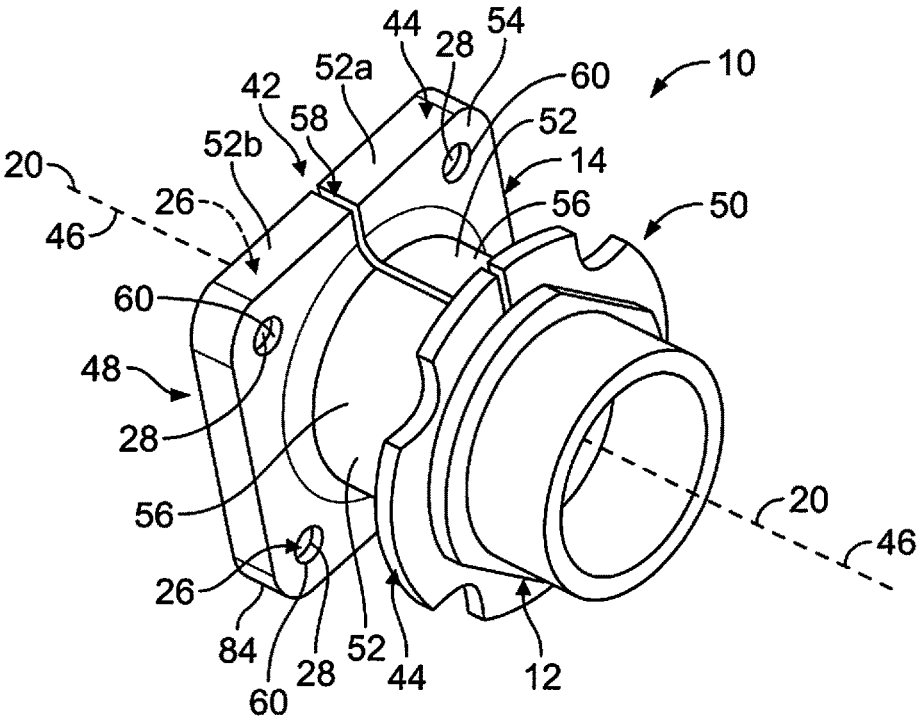
FIG. 3 is perspective view of the connector assembly shown in FIG. 1.

FIG. 3 is perspective view of the connector assembly 10 illustrating the protective cover 14. The cover 14 includes a metal shell 42 having a body 44 that extends a length along a central longitudinal axis 46 from a mounting end 48 to a free end 50. The shell body 44 is defined by (i.e., includes) one or more shell segments 52. In the illustrated embodiment, the shell body 44 is defined by two shell segments 52*a* and 52*b*. But, the shell body 44 may be defined by any other number of shell segments 52. For example, in some other embodiments, the shell body 44 is defined by a single shell segment 52 or is defined by three shell segments 52.

The body 44 of the shell 42 is metallized such that the shell 42 is a "metal shell". In other words, the shell body 44 includes metal, which may include any metal and/or any metal alloy. In the illustrated embodiment, each of the shell segments 52 of the shell body 44 is a solid metal body fabricated from one or more metals and/or one or more metal alloys. But, in some other embodiments, one or more of the shell segments 52 of the shell body 44 is: fabricated from one or more non-metallic materials coated (e.g., plated and/or the like) with one or more metals and/or one or more metal alloys; filled with one or more metals and/or one or more metal alloys; impregnated with one or more metal and/or one or more metal alloys; and/or the like. Moreover, in some other embodiments, one or more of the shell segments 52 of the shell body 44 includes a solid metal body that is coated with one or more non-metallic materials (e.g., an electrically and/or thermally insulating material coating an exterior side 66 [FIG. 4] of one or more shell segments 52). In some other embodiments, the metallized shell body 44 includes a shell segment 52 that is not metallized (i.e., does not include a metal or metal alloy). For example, in some other embodiments, the metallized shell body 44 includes a metallized upper shell segment 52 and/or one or more metallized side shell segments 52 and a lower shell segment 52 (e.g., that faces generally vertically downward) that is not metallized. In such embodiments, the metallized upper and/or side shell segments 52 may be used to protect the connector 12 from impact damage while the non-metallized lower shell segment 52 may be used to protect (in addition or alternative to the metallized upper and/or side shell segments 52) the connector 12 from environmental damage from rain, snow, moisture, dirt, debris, and/or the like.

Figure 4:
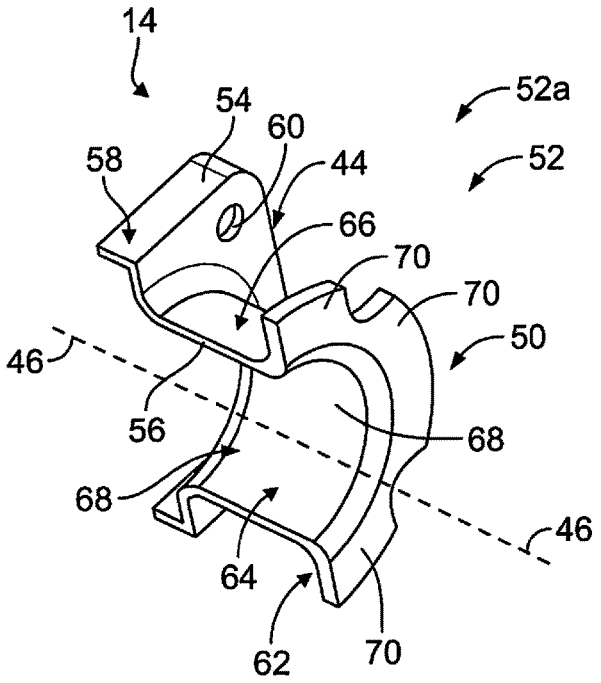
FIG. 4 is a perspective view of an embodiment of a shell segment of an embodiment of a protective cover of the connector assembly shown in FIGS. 1 and 4.

FIG. 4 is a perspective view of an embodiment of a shell segment 52*a* of the cover 14. Referring now to FIGS. 3 and 4, each shell segment 52 of the shell body 44 includes a base 54 and a support wall 56 that extends outward from the base 54. In the illustrated embodiment and other embodiments wherein the shell body 44 is defined by more than one shell segment 52, the bases 54 of the shell segments 52 define a base 58 of the body 44 of the metal shell 42, as shown in FIG. 3.

The base 54 of each shell segment 52 is configured to be mounted to the host structure 16 (FIGS. 1, 5, and 7) to thereby mount the shell body 44 to the host structure 16. In the illustrated embodiment, the base 54 includes mounting openings 60 that are configured to receive the threaded fasteners 30 (FIGS. 1, 5, and 7) that cooperate with the host structure 16 for mounting the shell segment 52, and thereby the shell body 44, to the wall 16*a* (FIGS. 1, 5, and 7) of the host structure 16. In the illustrated embodiment, the shell segments 52 are configured to be mounted to the host structure 16 using the same mounting apparatus (i.e., the threaded fasteners 30, the openings 28 best seen in FIG. 2, any threaded or non-threaded openings of the wall 16*a*, and any other threaded or non-threaded fasteners) that is used to mount the connector 12 (not shown in FIG. 4) to the host structure 16. While all of the mounting locations are shown as being shared by the connector 12 and the cover 14 in the illustrated embodiment, in some other embodiments the cover 14 is mounted to the host structure 16 using only one or only some of the locations of the mounting apparatus used to mount the connector 12 to the host structure 16. In some other embodiments, the shell body 44 is configured to be mounted to the host structure 16 separately from the connector 12 (i.e., without using any of the mounting apparatus that is used to mount the connector 12 to the host structure 16).

The cover 14 is not limited to including the bases 54 nor the mounting openings 60 for mounting the shell segments 52 of the shell body 44 to the host structure 16. Rather, in addition or alternatively to the base 54 and/or the mounting opening(s) 60, each shell segment 52 may include any other structure (e.g., one or more pins, one or more threaded mounting openings, a press-fit [i.e., an interference-fit] structure, a bayonet connection structure, one or more tabs and/or other structures for receiving a discrete clip, latch, clamp, and/or other non-threaded fastener, one or more integral clips, latches, clamps, and/or other non-threaded fasteners, and/or the like for mounting the shell segment 52 to the host structure 16. Although the illustrated embodiment includes two, each shell segment 52 may include any number of the mounting openings 60.

Optionally, the base 54 of each shell segment 52 is configured to be mounted to the host structure 16 over the mounting flange 26 (not shown in FIG. 4) of the connector 12 such that the base 54 covers at least a portion of the mounting flange 26, as is shown in FIG. 3. The base 58 of the shell body 44 may cover any amount of the mounting flange 26. Moreover, the base 54 of each shell segment 52 may cover any amount of the mounting flange 26. In the illustrated embodiment, the base 54 of each shell segment 52 covers approximately half of the mounting flange 26 such that the base 58 of the shell body 44 covers an approximate entirety of the mounting flange 26.

Referring now solely to FIG. 4, the support wall 56 of each shell segment 52 extends a length outward from the base 54 of the shell segment 52 along the central longitudinal axis 46 to an end 62. The end 62 of the support wall 56 defines at least a portion of the free end 50 of the shell body 44. The support wall 56 includes an interior side 64 and an exterior side 66. The interior side 64 defines a connector pocket 68 that extends axially along the interior side 64. The connector pocket 68 is configured to receive therein a corresponding sub-segment 32*a* (FIGS. 1 and 5) of the cantilevered connector segment 32 (FIGS. 1, 2, 5, and 7) of the connector 12 when the shell segment 52*a* is mounted to the host structure 16. As will be described below, when the sub-segment 32*a* is received within the connector pocket 68, the support wall 56 covers the corresponding sub-segment 32*a* to provide the cantilevered connector segment 32 of the connector 12 with impact protection along the sub-segment 32*a*.

The connector pocket 68 of each support wall 56 may or may not have a complementary shape relative to the corresponding sub-segment of the cantilevered connector segment 32 of the connector 12. Moreover, each sub-segment of the cantilevered connector segment 32 may or may not engage in physical contact with the interior side 64 of the corresponding support wall 56. In the illustrated embodiment, the connector pocket 68 of the shell segment 52*a* has a complementary shape relative to the corresponding sub-segment 32*a* of the cantilevered connector segment 32 such that the sub-segment 32*a* is configured to nest within the connector pocket 68 of the shell segment 52*a* in physical contact with the interior side 64 of the support wall 56.

The support wall 56 optionally includes one or more strengthening ribs 70 that extend radially outward relative to the central longitudinal axis 46. The strengthening ribs 70 facilitate increasing a rigidity of the support wall 56, which may increase the amount of impact protection provided by the cover 14. In the illustrated embodiment, the strengthening ribs 70 extend radially outward at the end 62 of the support wall 56 for increasing the rigidity of the support wall 56 at the end 62. But, the support wall 56 additionally or alternatively may include one or more strengthening ribs 70 that each extend radially outward at any other location along the length of the support wall 56. Although shown as extending radially outward at an approximate perpendicular angle relative to the central longitudinal axis 46, one or more of the strengthening ribs 70 may extend radially outward at an oblique angle relative to the central longitudinal axis 46. The support wall 56 may include any number of strengthening ribs 70.

FIG. 5 is another perspective view of the connector assembly 10 illustrating the assembly 10 mounted to the host structure 16. Referring now to FIGS. 1 and 5, the connector 12 is mounted to the wall 16*a* of the host structure 16 using the mounting openings 28 (FIGS. 2 and 3) and the threaded fasteners 30. As shown in FIGS. 1 and 5, the connector body 18 is mounted to the wall 16*a* of the host structure 16 such that the cantilevered connector segment 32 of the connector body 18 extends outward from the wall 16*a* to the mating end 24 of the connector body 18. The mating end 24 of the connector body 18 is a free end. In other words, without considering the cover 14, the mating end 24 is not supported by any structure other than the remainder of the length of the cantilevered connector segment 32. Accordingly, the cantilevered connector segment 32 extends outwardly from the wall 16*a* of the host structure 16 in a cantilevered arrangement, as is shown in FIGS. 1 and 5. In other words, the cantilevered connector segment 32, and thus the connector 12, is cantilevered from the wall 16*a* of the host structure 16.

The cover 14 is mounted to the wall 16*a* of the host structure 16. In the illustrated embodiment, the cover 14 is mounted to the host structure wall 16*a* using the mounting openings 60 (FIGS. 3 and 4) and the same threaded fasteners 30 as the connector 12. The support wall 56 of each shell segment 52 extends outward from the base 54, and thus from the host structure wall 16*a*, over the corresponding sub-segment of the cantilevered connector segment 32. Specifically, in the illustrated embodiment, the support wall 56 of the shell segment 52*a* extends over the sub-segment 32*a*, and the support wall 56 of the shell segment 52*b* extends over a sub-segment 32*b* of the cantilevered connector segment 32. The support walls 56 extend over the sub-segments 32*a* and 32*b* of the cantilevered connector segment 32 such that the sub-segments 32*a* and 32*b* are received within the connector pockets 68 of the support walls 56 of the shell segments 52*a* and 52*b*, respectively. The support walls 56 of the shell segments 52*a* and 52*b* thus cover the sub-segments 32*a* and 32*b*, respectively, to provide the cantilevered connector segment 32 of the connector 12 with impact protection along the sub-segments 32*a* and 32*b*.

Specifically, the body 44 of the metal shell 42 defined by the shell segments 52*a* and 52*b* is cantilevered from the wall 16*a* of the host structure 16 around at least a portion of the circumference and along at least a portion of the length of the cantilevered connector segment 32. The body 44 of the metal shell 42 of the cover 14 thus provides a metal barrier that covers at least a portion of the cantilevered connector segment 32 of the connector 12 for protecting the connector 12 from impact damage. For example, the metallized shell body 44 increases the rigidity, strength, and/or the like of the cantilevered connector segment 32. The increased rigidity, strength, and/or the like, as well as the general barrier or enclosure, provided by the cover 14 facilitates protecting the connector 12 from impact damage. Specifically, the impact protection provided by the cover 14 may reduce or eliminate damage to the cantilevered connector segment 32 of the connector 12 caused by the segment 32 being inadvertently hit, bumped, kicked, and/or otherwise impacted by person. Moreover, the impact protection provided by the cover 14 may reduce or eliminate damage to the cantilevered connector segment 32 caused by the segment 32 being impacted by another object, such as, but not limited to, a tool, a door, a vehicle, a falling object, and/or the like. One specific example of impact protection provided by the cover 14 includes preventing the cantilevered connector segment 32 from being partially or completely severed from the wall 16*a* of the host structure 16, which may reduce or eliminate a hazardous electrical issue by preventing any electrical contacts and/or other electrical conductors associated with the connector 12 from being exposed.

Optionally, the cover 14 may be provided as a retrofit. Specifically, the cover 14 may be mounted to the wall 16*a* of the support structure 16 at initial installation of the connector 12 to the host structure 16 or the cover 14 may be retrofitted to the connector 12 by being mounted to the host structure 16 at some time after the connector 12 has been mounted to the host structure 16 (e.g., after the connector 12 has been used in place on the host structure 16).

In the illustrated embodiment, the body 44 of the metal shell 42 (defined by the shell segments 52) of the cover 14 is mounted directly to the wall 16*a* of the host structure 16. By mounting the cover 14 directly to the host structure 16, the cover 14 may provide an increased amount of impact protection as compared to embodiments wherein the cover 14 is mounted only to the connector 12. For example, the cover 14 may provide the connector 12 with a stronger mechanical connection to the wall 16*a* of the host structure 16 (as compared to the cover 14 only being mounted to the connector 12), which may facilitate preventing the cantilevered connector segment 32 from being completely or partially severed from the wall 16*a*. Moreover, and for example, the cover 14 itself may have a stronger connection to the wall 16*a* of the host structure 16 such that the cover 14 can withstand, and thus shield the connector 12 from, greater impacts as compared to embodiments wherein the cover 14 is only mounted to the connector 12.

As discussed above, the base 54 of each shell segment 52 optionally is configured to be mounted to the host structure 16 over the mounting flange 26 of the connector 12 such that the base 54 covers at least a portion of the mounting flange 26. Covering at least a portion of the mounting flange 26 may facilitate protecting the mounting flange from impact damage, which may reduce or prevent degradation of the mechanical connection between the connector 12 and the wall 16*a* of the host structure 16.

The body 44 of the shell 42 of the cover 14 may cover any amount of the circumference and any amount of the length of the cantilevered connector segment 32 of the connector 12, regardless of the number of shell segments 52 used to define the shell 42. In the illustrated embodiment, the shell 42 of the cover 14 covers an approximate entirety of the circumference of the cantilevered connector segment 32 along a portion of the length of the cantilevered connector segment 32. In some other embodiments, the shell 42 extends a length to or past the mating end 24 of the cantilevered connector segment 32. In some other embodiments, one or more voids, openings, holes, and/or the like are included within one or more support walls 56 of the shell segments 52, for example to reduce a weight, material cost, and/or the like of the cover 14. In some other embodiments, two or more support walls 56 of the same shell segment 52 extend from a common base 54.

When the cover 14 is mounted to the host structure 16 over the cantilevered connector segment 32 of the connector 12, optionally the shell segments 52 are spaced apart by a relatively small gap 74, as is shown in FIGS. 1 and 5. In some other embodiments, the shell segments 52 are engaged in physical contact with each other at the locations of the gaps 74 (i.e., instead of the gaps 74). Moreover, in some other embodiments, the support walls 56 of the shell segments 52 are configured to be interlocked together.

Figure 6:
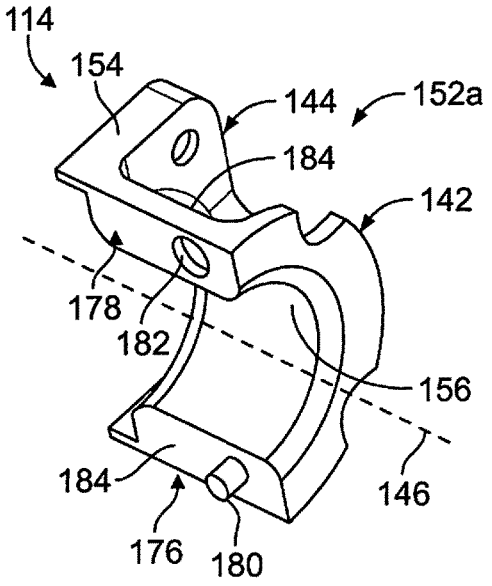
FIG. 6 is a perspective view of an embodiment of a shell segment of another embodiment of a protective cover.

For example, FIG. 6 is a perspective view of an embodiment of a shell segment 152*a* of another embodiment of a protective cover 114. The shell segment 152*a* includes a base 154 and a support wall 156 that extends outward from the base 154. The support wall 156 is configured to be interlocked with the support wall 156 of another shell segment 152*b* (FIG. 7) that along with the shell segment 152*a* defines a body 144 of a metal shell 142 of the cover 114. Specifically, the support wall 156 of the shell segment 152*a* includes ends 176 and 178 that are configured to interlock with corresponding ends (not labeled herein) of the shell segment 152*b*. Interlocking the support walls 156 of the shell segments 152*a* and 152*b* together may increase a rigidity, strength, and/or the like of the cover 114, which may facilitate providing the connector 12 with an increased amount of impact protection.

In the illustrated embodiment, the ends 176 and 178 include pins 180 and openings 182 to interlock with each other. Each opening 182 receives a corresponding pin (not shown) of the shell segment 152*b* therein and the pin 180 is received within a corresponding opening (not shown) of the shell segment 152*b* to interlock the shell segments 152*a* and 152*b*. The shell segments 152*a* and 152*b* are shown as interlocked in FIG. 7. Each of the ends 176 and 178 may include any number of the pins 180 and any number of the openings 182. In addition or alternatively to the pins 180 and/or the openings 182, the shell segments 152 and/or 152*b* may include any other structure that enables the support walls 156 to be interlocked together, such as, but not limited to, one or more threaded fasteners, one or more clips, one or more clamps, and/or the like.

The support wall 156 optionally includes one or more support ribs 184 that extend along the length of the support wall 156. Specifically, the support ribs 184 extend along a central longitudinal axis 146 of the shell body 144 of the cover 114. The support ribs 184 facilitate increasing a rigidity of the support wall 156, which may increase the amount of impact protection provided by the cover 114. In the illustrated embodiment, the support ribs 184 extend at the ends 176 and 178 of the support wall 156. But, the support wall 156 additionally or alternatively may include one or more support ribs 184 that each extend at any other location along the length of the support wall 156. Although shown as extending approximately parallel to the central longitudinal axis 146, one or more of the support ribs 184 may extend along the length of the support wall 156 at another angle relative to the central longitudinal axis 146. The support wall 156 may include any number of support ribs 184.

FIG. 7 is a perspective view of an embodiment of another connector assembly 110 that includes the connector 12 and the protective cover 114 (partially shown in FIG. 6) illustrating the assembly 110 mounted to the wall 16*a* of the host structure 16. The cover 114 is mounted to the wall 16*a* of the host structure 16. The support wall 156 of each shell segment 152*a* and 152*b* extends outward from the base 154, and thus from the host structure wall 16*a*, over the corresponding sub-segment of the cantilevered connector segment 32 of the connector 12. The support walls 156 thus cover the sub-segments to provide the cantilevered connector segment 32 of the connector 12 with impact protection. The body 144 of the metal shell 142 of the cover 114 thus provides a metal barrier that covers at least a portion of the cantilevered connector segment 32 of the connector 12 for protecting the connector 12 from impact damage.

The embodiments described and/or illustrated herein may provide a cover that provides a metal barrier that covers at least a portion of a connector for protecting the connector from impact damage. The embodiments described and/or illustrated herein may reduce repair and/or replacement costs of a connector.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A protective cover for a connector that is mounted to a first side of a host structure, said cover comprising:

a metal shell having a body extending a length along a central longitudinal axis between a mounting end and a free end, the body defined by at least one shell segment that includes a base at the mounting end and a strengthening rib at the free end with a support wall that extends between the base and the strengthening rib, the support wall comprising an interior side that defines a connector pocket, the support wall extending at least partially circumferentially around the connector pocket along the central longitudinal axis, the connector pocket being configured to receive therein a corresponding sub-segment of a cantilevered connector segment of the connector that is cantilevered from the first side of the host structure, the base of the shell segment being configured to be mounted to the first side of the host structure over a mounting flange of the connector with the support wall extending outward from the host structure over the corresponding sub-segment of the cantilevered connector segment such that the body of the metal shell is cantilevered from the first side of the host structure around at least a portion of a circumference and along at least a portion of a length of the cantilevered connector segment to provide a metal barrier that covers at least a portion of the cantilevered connector segment of the connector.

2. The cover of claim 1, wherein the support wall of the shell segment extends a length outward from the base, the support wall comprising a support rib that extends along the length thereof.

3. The cover of claim 1, wherein the support wall of the shell segment extends a length along the central longitudinal axis of the body to the free end, the free end of the support wall comprising the strengthening rib that extends radially outward relative to the central longitudinal axis.

4. The cover of claim 1, wherein the connector pocket of the support wall has a complementary shape relative to the corresponding sub-segment of the cantilevered connector segment, wherein the connector pocket and the corresponding sub-segment of the cantilevered connector segment are non-threaded.

5. The cover of claim 1, wherein the connector is configured to be mounted to the host structure using a mounting apparatus, the base of the shell segment being configured to be mounted to the host structure using at least some of the same mounting apparatus that is used to mount the connector to the host structure.

6. The cover of claim 1, wherein the at least one shell segment comprises two shell segments, the support walls of the shell segments being configured to be interlocked together.

7. The cover of claim 1, wherein the at least one shell segment comprises two shell segments, the support walls of the shell segments being configured to be interlocked together using at least one of a pin or a threaded fastener.

8. The cover of claim 1, wherein the at least one shell segment of the body of the metal shell comprises two shell segments.

9. The cover of claim 1, wherein the mounting flange of the connector is configured to be positioned between the base of the cover and the host structure.

10. The cover of claim 1, wherein the mounting flange of the connector has a number of mounting openings and the base of the cover has the same number of mounting openings, wherein the mounting openings of the cover are configured to be positioned over the mounting openings of the connector in order to receive threaded fasteners.

11. A connector assembly comprising:

a connector comprising a cantilevered connector segment, the connector is configured to be mounted to a first side of a host structure such that the cantilevered connector segment is cantilevered from the first side of the host structure and extends a length to a mating end, the cantilevered connector segment includes a mounting flange at a mounting end and an optional flange at the mating end, the cantilevered connector segment comprising at least one sub-segment; and a protective cover for the connector, the cover comprising a metal shell having a body extending a length along a longitudinal axis between a mounting end and a free end, the body defined by at least one shell segment that includes a base at the mounting end and a strengthening rib at the free end with a support wall that extends between the base and the strengthening rib, the support wall comprising an interior side that defines a connector pocket, the support wall extending at least partially circumferentially around the connector pocket along the longitudinal axis, the connector pocket being configured to receive the sub-segment of the cantilevered connector segment of the connector therein, the base of the shell segment being configured to be mounted to the first side of the host structure over the mounting flange of the connector such that the mounting flange of the connector is configured to be positioned between the base of the cover and the host structure, the support wall extending outward from the first side of the host structure over the sub-segment of the cantilevered connector segment such that the body of the metal shell is cantilevered from the first side of the host structure around at least a portion of a circumference and along at least a portion of a length of the cantilevered connector segment to provide a metal barrier that covers at least a portion of the cantilevered connector segment of the connector.

12. The assembly of claim 11, wherein the support wall of the shell segment extends a length outward from the base along the central longitudinal axis of the body, the support wall comprising at least one of a support rib that extends along the length thereof or the strengthening rib that extends radially outward relative to the central longitudinal axis.

13. The assembly of claim 11, wherein the connector pocket of the support wall has a complementary shape relative to the sub-segment of the cantilevered connector segment, wherein the connector pocket and the corresponding sub-segment of the cantilevered connector segment are non-threaded.

14. The assembly of claim 11, wherein the connector is configured to be mounted to the host structure using a mounting apparatus, the base of the shell segment being configured to be mounted to the host structure using at least some of the same mounting apparatus that is used to mount the connector to the host structure.

15. The assembly of claim 11, wherein the at least one shell segment comprises two shell segments, the support walls of the shell segments being configured to be interlocked together.

16. A protective cover for a connector that is mounted to a first side of a host structure, said cover comprising:

a metal shell having a body extending a length along a central longitudinal axis between a mounting end and a free end, the body defined by at least one shell segment that includes a base at the mounting end and a strengthening rib at the free end with a support wall that forms part of a cylinder around the connector between the base and the strengthening rib, and that extends between the base and the strengthening rib, the support wall comprising an interior side that defines a connector pocket, the support wall extends at least partially circumferentially around the connector pocket along the central longitudinal axis, the connector pocket being configured to receive therein a corresponding sub-segment of a cantilevered connector segment of the connector that is cantilevered from the first side of the host structure, the base of the shell segment being configured to be mounted to the first side of the host structure over a mounting flange of the connector such that the support wall extends outward from the base over the corresponding sub-segment of the cantilevered connector segment to provide a metal barrier that covers at least a portion of the cantilevered connector segment of the connector.

17. The cover of claim 16, wherein the support wall of the shell segment extends a length outward from the base along the central longitudinal axis of the body, the support wall comprising at least one of a support rib that extends along the length thereof or the strengthening rib that extends radially outward relative to the central longitudinal axis.

18. The cover of claim 16, wherein the connector pocket of the support wall has a complementary shape relative to the corresponding sub-segment of the cantilevered connector segment, wherein the connector pocket and the corresponding sub-segment of the cantilevered connector segment are non-threaded.

19. The cover of claim 16, wherein the connector is mounted to the host structure using a mounting apparatus, the base of the shell segment being configured to be mounted to the host structure using at least some of the same mounting apparatus that is used to mount the connector to the host structure.

20. The cover of claim 16, wherein the at least one shell segment comprises two shell segments, the support walls of the shell segments being configured to be interlocked together.

* * * * *